US009330857B2

(12) United States Patent
Muld

(10) Patent No.: US 9,330,857 B2
(45) Date of Patent: May 3, 2016

(54) SWITCH AND SWITCH OPERATOR ASSEMBLY WITH SAFETY MECHANISM

(71) Applicant: Mark H Muld, Snohomish, WA (US)

(72) Inventor: Mark H Muld, Snohomish, WA (US)

( * ) Notice: Subject to any disclaimer, the term of this patent is extended or adjusted under 35 U.S.C. 154(b) by 63 days.

(21) Appl. No.: 14/160,922

(22) Filed: Jan. 22, 2014

(65) Prior Publication Data

US 2014/0224626 A1 Aug. 14, 2014

Related U.S. Application Data

(60) Provisional application No. 61/850,252, filed on Feb. 11, 2013.

(51) Int. Cl.
*H01H 3/14* (2006.01)
*H01H 3/20* (2006.01)

(52) U.S. Cl.
CPC .. *H01H 3/20* (2013.01); *H01H 3/14* (2013.01)

(58) Field of Classification Search
CPC ..... H01H 3/14
USPC ..... 200/86.5
See application file for complete search history.

(56) References Cited

U.S. PATENT DOCUMENTS

| | | | | |
|---|---|---|---|---|
| 1,292,030 | A | | 1/1919 | Parissi |
| 1,508,611 | A | | 9/1924 | Parissi |
| 1,630,914 | A | | 5/1927 | Williams |
| 1,815,941 | A | | 7/1931 | Blair et al. |
| 1,869,045 | A | | 7/1932 | Bridgeman |
| 1,872,618 | A | | 8/1932 | Butte |
| 1,954,391 | A | | 4/1934 | Matson |
| 1,966,062 | A | | 7/1934 | Derby |
| 2,828,379 | A | * | 3/1958 | Simonds et al. ..... 200/86.5 |
| 2,957,960 | A | | 10/1960 | Ginn |
| 3,014,229 | A | | 12/1961 | Fassio |
| 3,466,411 | A | | 9/1969 | Martin |
| 3,759,115 | A | | 9/1973 | Dibonaventura et al. |
| 3,916,722 | A | | 11/1975 | Grobe |
| 4,376,240 | A | | 3/1983 | Stuart |
| 4,496,811 | A | | 1/1985 | Irwin |
| 4,713,509 | A | | 12/1987 | Chebowski |
| 4,839,533 | A | | 6/1989 | Aga |
| 5,166,513 | A | | 11/1992 | Keenan et al. |
| 5,383,875 | A | | 1/1995 | Bays et al. |
| 5,458,417 | A | | 10/1995 | Grelich |
| 5,511,763 | A | | 4/1996 | Green |
| 5,619,767 | A | | 4/1997 | Larson |
| 5,773,281 | A | | 6/1998 | Ichikawa et al. |
| 5,941,504 | A | | 8/1999 | Toma et al. |
| 6,313,421 | B1 | | 11/2001 | Abrahamsen |
| 6,362,441 | B1 | | 3/2002 | Xie |
| 6,504,117 | B2 | | 1/2003 | Overstreet |

* cited by examiner

*Primary Examiner* — Renee S Luebke
*Assistant Examiner* — Lheiren Mae A Caroc
(74) *Attorney, Agent, or Firm* — Glenn Rickards

(57) ABSTRACT

A safety switch may be mountable proximate to the floor and may include a switch that may be actuated by vertical movement of a generally horizontally-extending switch operator plate as by pivoting about a horizontal axis at one side thereof. The safety switch may further include a blocking arm pivotable about a horizontal axis, the axis being perpendicular to the pivotal axis of the switch operator plate, wherein the blocking arm is normally biased into a vertical blocking position to prevent vertical movement of the switch operator plate. The switch may be actuated by the switch operator plate by pivoting the blocking arm into a vertical orientation and then moving the switch operator plate vertically into actuating contact with the switch.

6 Claims, 12 Drawing Sheets

SWITCH AND SWITCH OPERATOR ASSEMBLY WITH SAFETY MECHANISM

TECHNICAL FIELD

The present disclosure relates generally to mechanically actuated switches and, more particularly, such switches generally designed to be located remote from equipment to be energized. The switch operator assembly is particularly adapted but not limited to foot actuation. The switch operator assembly is integrated with a safety mechanism for virtually eliminating the problem of accidental actuation, especially in environments such as found with domestic or commercial food processing equipment and/or garbage disposal units. The switching assembly and safety mechanism is, of course, capable of being utilized in broader fields such as general industrial use.

BACKGROUND INFORMATION

Although proposals have been made for the use of remote foot operated switches for domestic, commercial and industrial settings, a particular problem arises in the case of foot switches which are designed to be located in positions hidden from view. Such use arises, for instance, with switches located in "toe kick" spaces commonly found beneath kitchen or bathroom sink cabinets. Accidental or inadvertent switch actuation presents serious safety issues with these installations. Such areas are usually high activity areas and the switch is more or less hidden from view in the "toe kick" area of a cabinet. Prior attempts at foot operated switches in these environments are prone to accidental activation by a simple horizontal or vertical motion by, for instance, a broom, child, vacuum cleaner or the foot of a person standing by the toe kick area.

DETAILED DESCRIPTION

The presently disclosed switching assembly requires a deliberate multi-step, multi-directional foot movement for actuation, thus eliminating safety hazards. The safety switch assembly of the present disclosure is illustrated as it applies to a foot switch designed to be located in what is commonly referred to as the "toe kick" space of a kitchen or bathroom sink cabinet or other recess or overhang which is normally an area of high foot activity. In this embodiment, a switch and switch operator housing is secured to a baseboard surface beneath the overhang or protruding front surface of a cabinet housing. The switch and switch operator housing provides a pivotal mounting for a horizontal switch operator plate having a switch contact arm designed to actuate an electrical switch to the "on" position when the plate is moved or pivoted upwardly by the user's toe. In order to prevent unintended pivoting of the switch operator plate, a normally downwardly extending blocking arm is mounted on the operator plate for pivoting about a horizontal axis in the present embodiment. The blocking arm blocks pivoting of the operator plate until the blocking arm is moved in an upward direction by horizontal movement of the user's foot or toe to a position against the operator plate. The operator plate is thus freed to be operated vertically about its horizontal pivotal mounting by the user's foot or toe so as to activate the switch contact arm. The switch and switch operator housing is also provided with a downwardly extending vertical stop surface for limiting the foot movement in the horizontal direction.

The switch and switch operator assembly thus has three distinct positions: the first with the downwardly extending operator plate blocking arm in the vertical position and the electrical switch in the normally "off" position; the second, with the blocking arm being moved to the horizontal position into contact with the outer surface of the switch operator plate, the electrical switch remaining in the "off" position; and the third, with the operator plate pivoted by movement or lift of the user's toe to the raised position causing a switch contact arm to move the switch to the closed or "on" position. In the illustrated embodiment, the switch contact arm may include a leaf spring which serves to aid the return of the operator plate to the lower or unactuated position and the blocking arm may be caused to return to its vertical blocking position by spring means once the user's toe is removed from the switching assembly housing area. The blocking arm and operator plate may also be simply returned to the original unactuated position by gravity upon removal of the user's foot. A timing action may open the switch or the same action described may, of course, be used to return an on-off switch to the "off" position.

Figure 1:
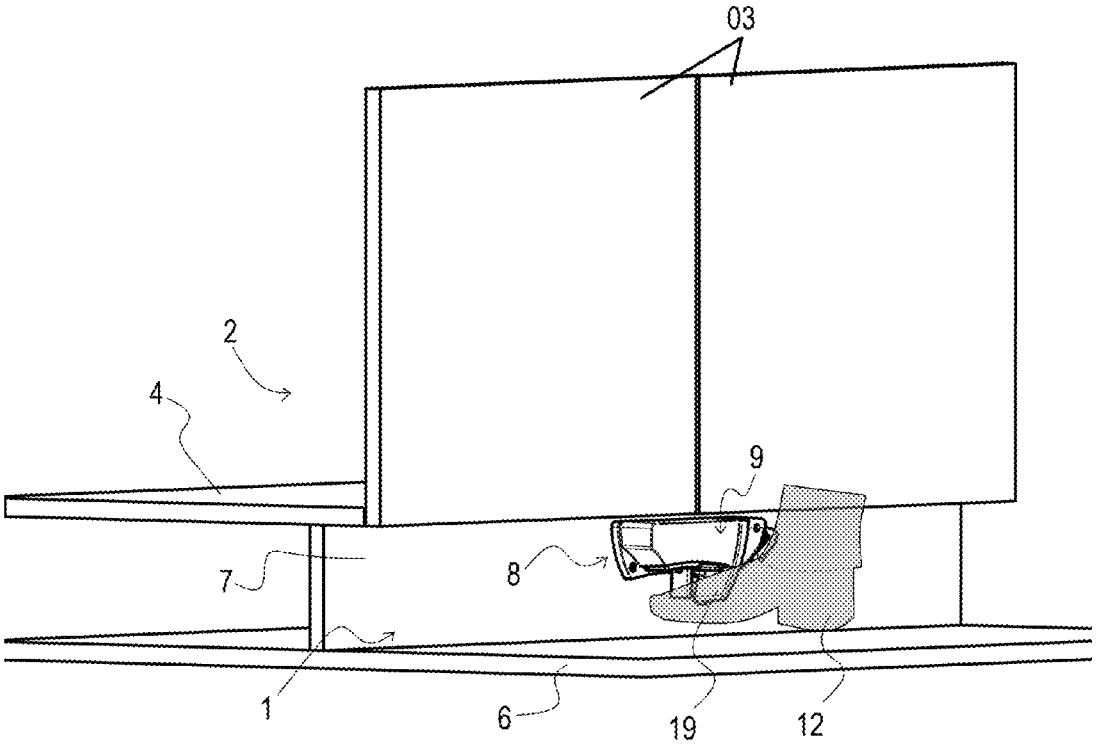
FIG. 1 is a perspective view of the switch, switch operator and safety mechanism installed in a baseboard toe kick area with the switch operator in a first unactuated position.
Figure 4:
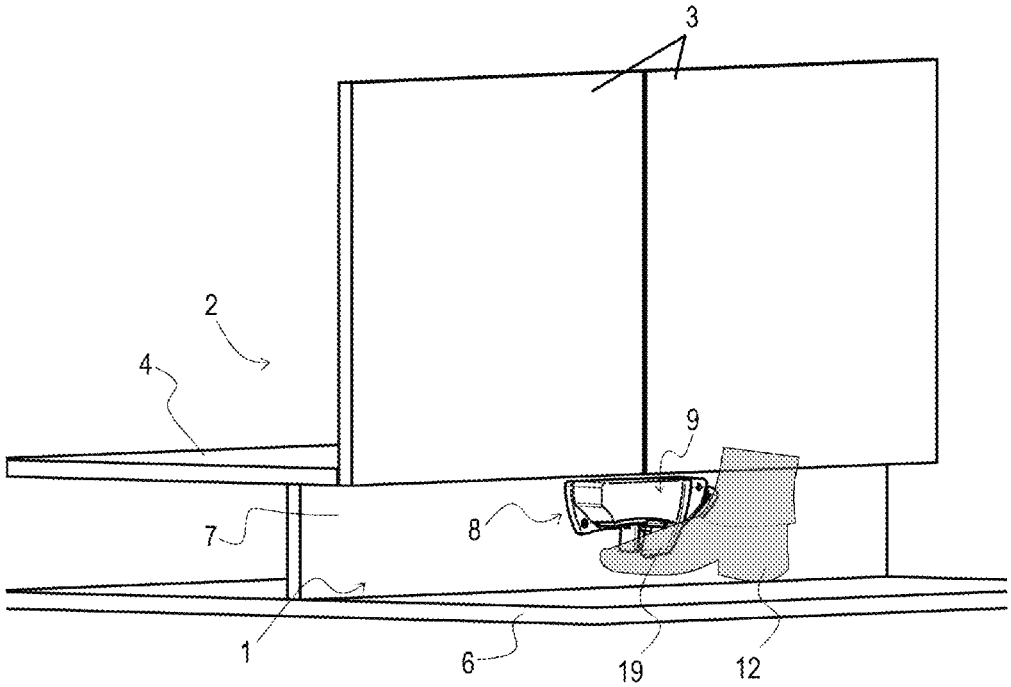
FIG. 4 is a perspective view of the switch, switch operator and safety mechanism installed in a baseboard toe kick area in a second position with the switch operator in the unactuated position and the safety mechanism in the switch operator release position.
Figure 7:
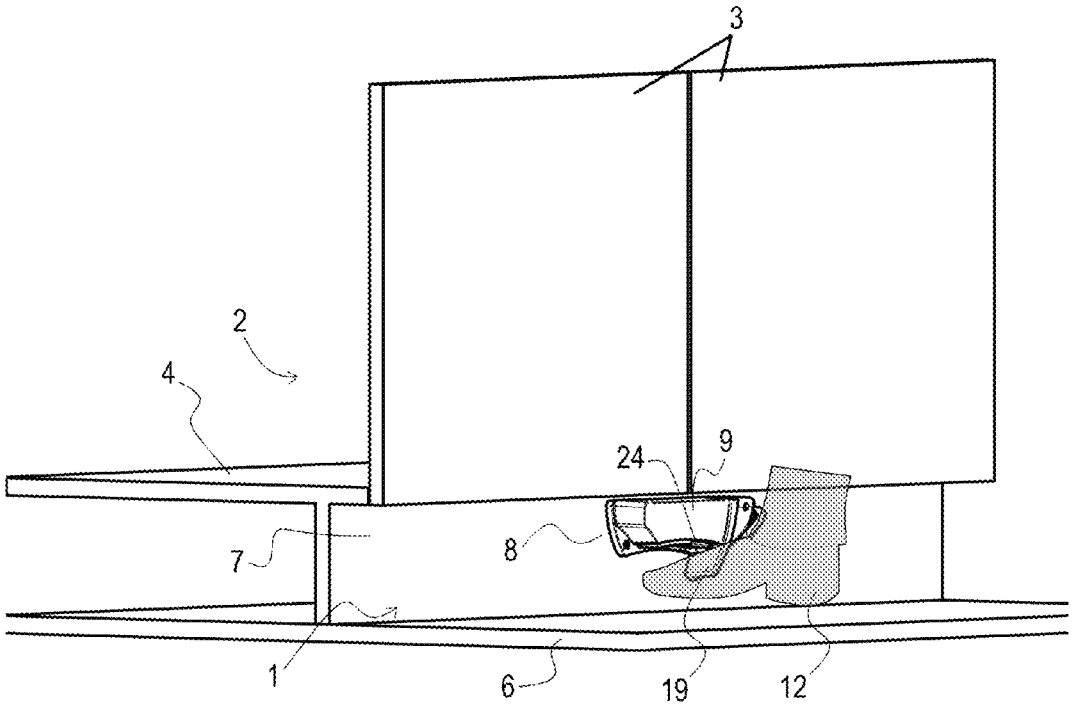
FIG. 7 is a perspective view of the switch, switch operator and safety mechanism installed in a baseboard toe kick area in a third position with the switch operator in the actuated position and the safety mechanism in the switch operator release position.
Figure 8:
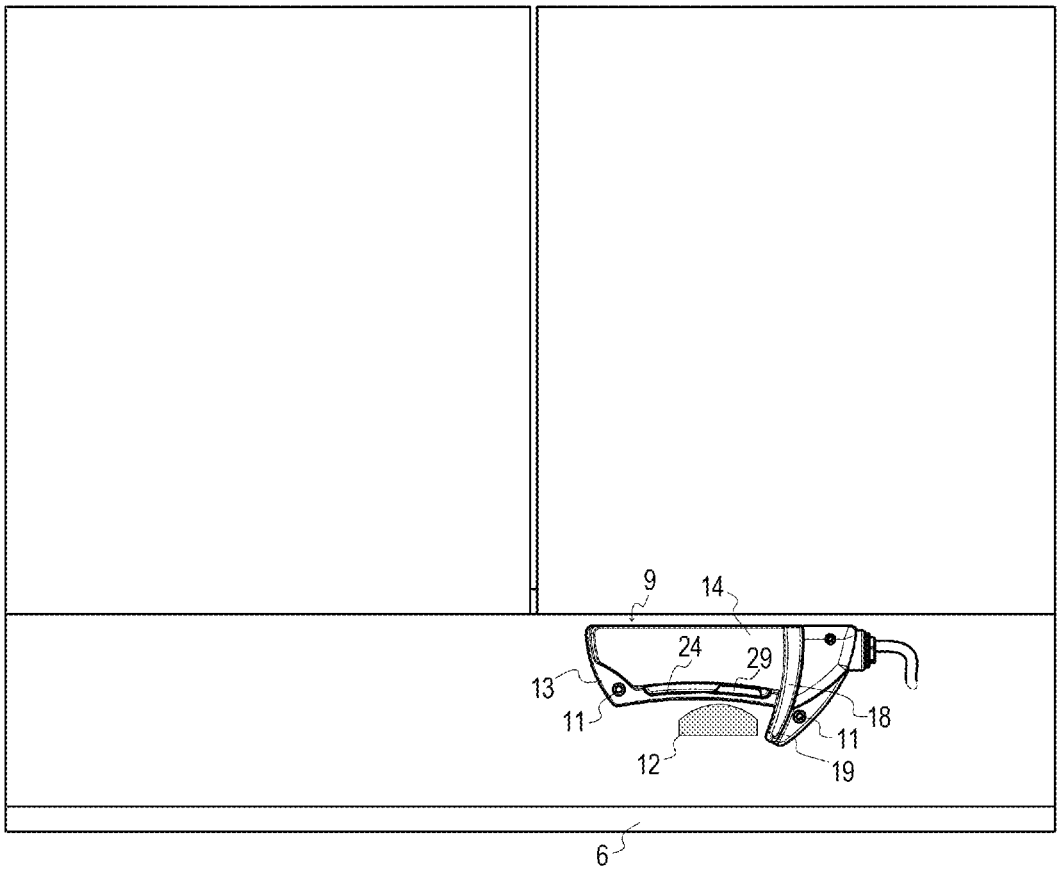
FIG. 8 is a front elevational view of the installed switch, switch operator and safety mechanism assembly of FIG. 7.
Figure 9:
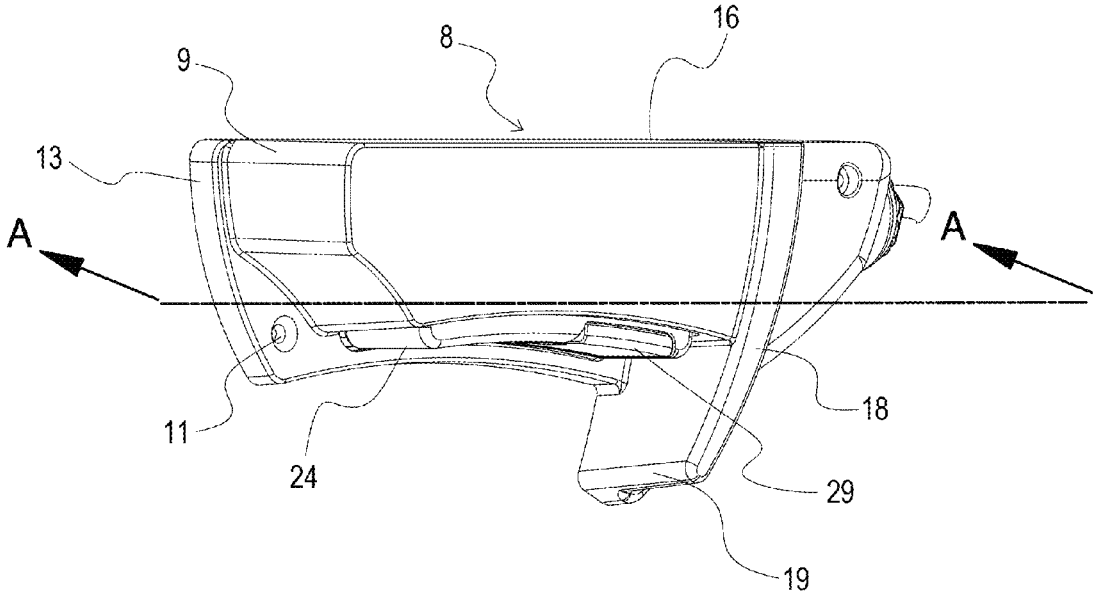
FIG. 9 is a perspective view of the installed switch, switch operator and safety mechanism of FIG. 8.
Figure 9A:
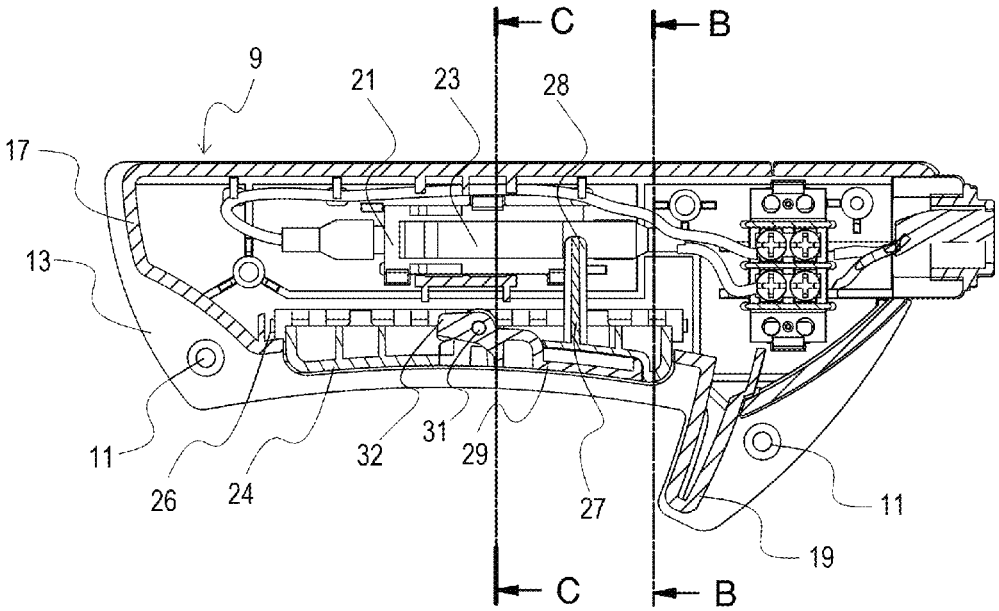
FIG. 9A is a cross sectional view taken along lines A-A of FIG. 9.
Figure 9C:
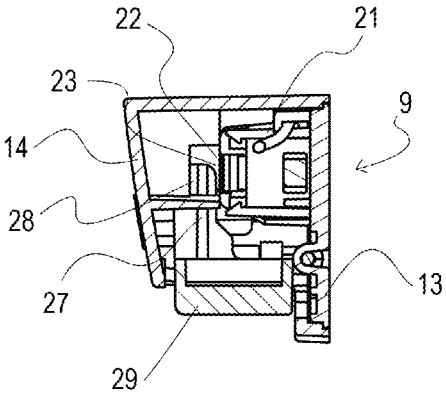
FIG. 9C is a cross sectional view taken along lines C-C of FIG. 9A
Figure 9B:
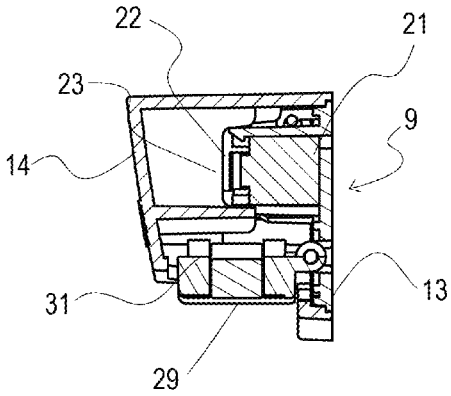
FIG. 9B is a cross sectional view taken along lines B-B of FIG. 9A.

Referring to FIGS. 1, 4 and 7 the "toe kick" space or area is indicated generally at 1 and, in the present embodiment, is defined by a cabinet structure indicated generally at 2 which includes the doors or other wall structure 3 and a bottom wall 4. The cabinet structure is normally spaced from the floor 6 by a baseboard support structure or the like 7 spaced inwardly from the face of the doors or wall surface 3 so as to form the recessed toe kick area. The switch and switch operator assembly 8 with its housing 9 being secured to the baseboard 7 by screw fasteners or the like 11 and placed at an appropriate position on the baseboard 7 so as to permit operation by the user's foot 12.

Figure 3:
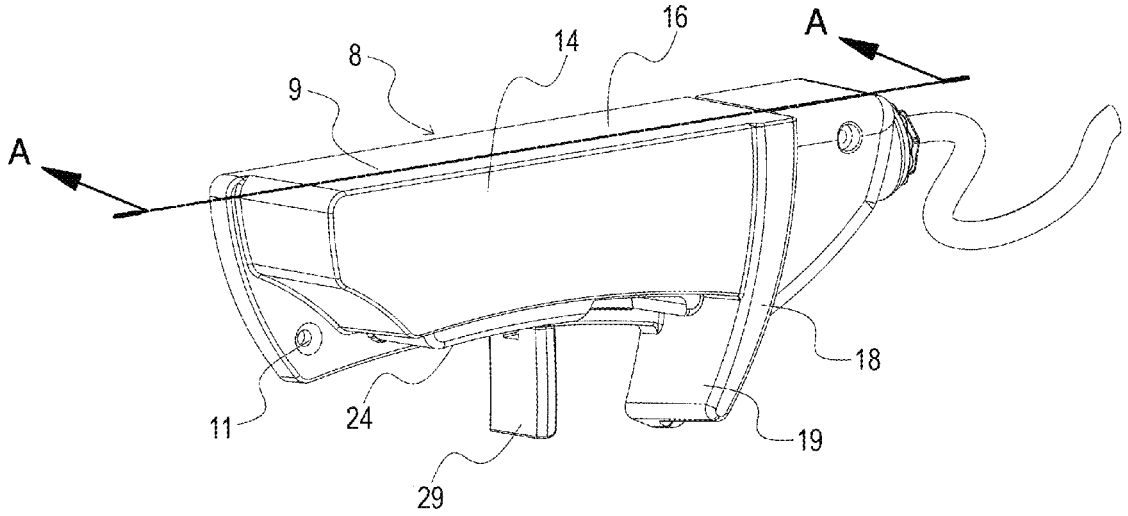
FIG. 3 is a perspective view of the switch, switch operator and safety mechanism of FIG. 1.
Figure 3A:
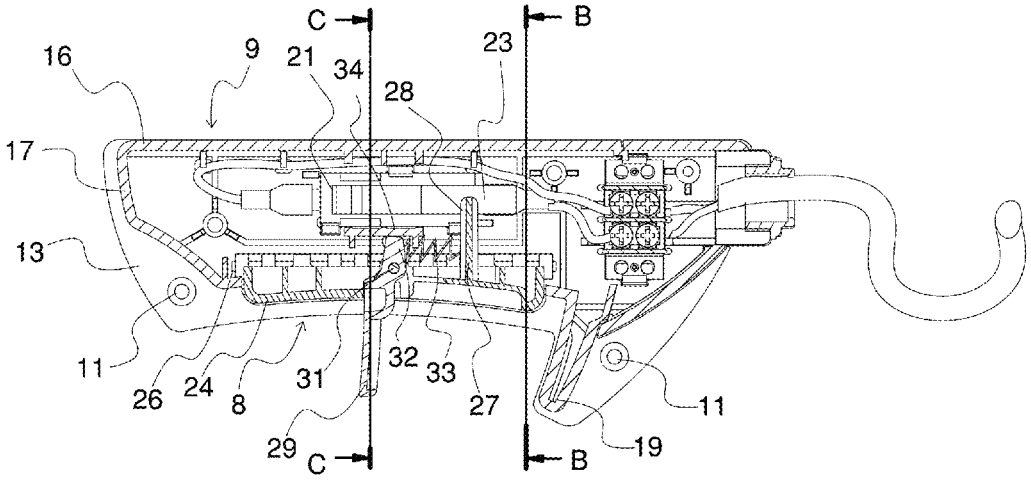
FIG. 3A is a cross sectional view taken along lines A-A of FIG. 3.

As best viewed in FIGS. 3 and 3A, the switch and switch operator housing 9 includes a back wall 13 for mounting against the baseboard 7 as previously described and a front wall 14 spaced forwardly therefrom. A planar top wall 16 extends between the walls 13 and 14 with a first end/bottom wall 17 and a second end wall 18 serving to form a closed housing for mounting the switch, switch operator and safety mechanism as will presently be described. As illustrated in the drawings, the wall 17 may be curved downwardly from the top wall 16 to serve as a guide for the initial horizontal movement of the user's foot. The end wall 18 will include a vertically downwardly extending fixed stop 19 so as to limit horizontal sideways movement of the user's foot during switch actuation as will presently be described. The structural detail of the housing may be varied depending on the particular installation and may be made from molded plastic or other suitable material.

Figure 2:
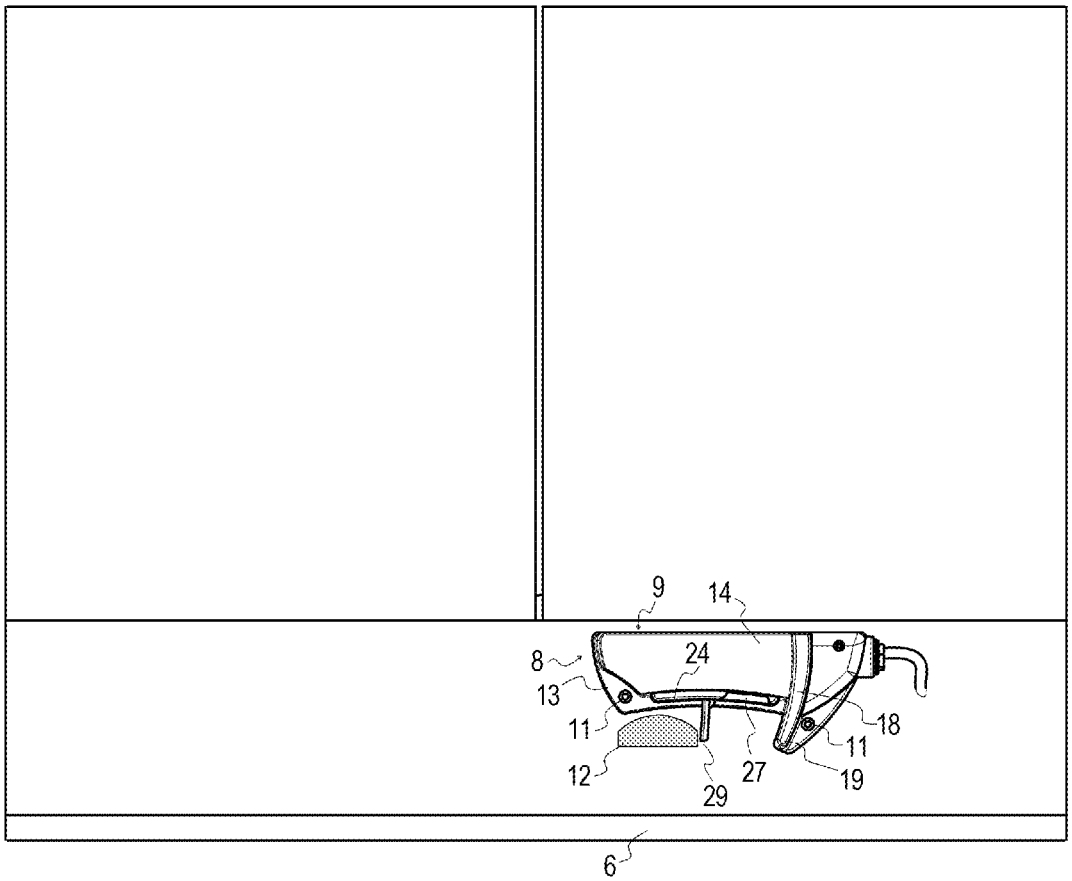
FIG. 2 is a front elevational view of the installed switch, switch operator and safety mechanism of FIG. 1.
Figure 3C:
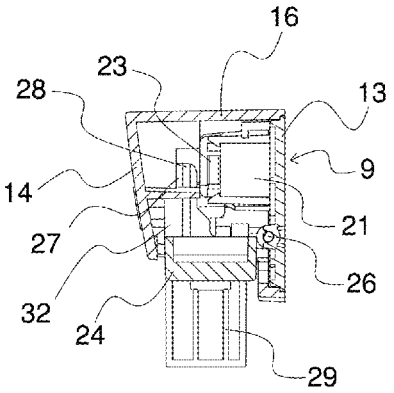
FIG. 3C is a cross sectional view taken along lines C-C of FIG. 3A showing the switch operator in the unactuated position.
Figure 3B:
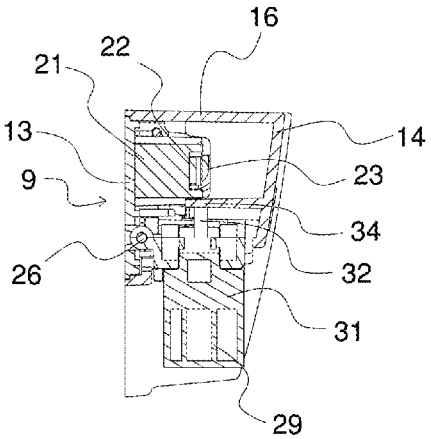
FIG. 3B is a cross sectional view taken along lines B-B of FIG. 3 showing the safety mechanism in the blocking position.

As aforementioned, in the initial or unactuated condition, the switch operator* plate is in the horizontal position and the operator plate blocking arm is in the vertical position as illustrated in FIGS. 1 and 2. Referring to FIGS. 3A-3C, the switch unit 21 may be securely mounted within the housing 9 on the back wall 13. The switch 21 may comprise any number of available electrical switches and, in the present disclosure, may include a depressable button or plunger 22 which will be spring biased between the on and off positions. It will be understood, however, that other types or designs of switches as, for instance, with timer features or the like may be adapted by one skilled in the art may be adapted for use with the disclosed structures. In the present disclosed embodiment, the switch unit 21 is provided with a leaf spring assist member 23 attached to its top surface and overlying the switch button 22 for a purpose to be described.

As shown most clearly in FIGS. 2-3C, a switch operator plate 24 is horizontally disposed and mounted on the housing 9 on a horizontal axis 26 along the back wall 13 as indicated most clearly in FIGS. 3A-3C. The switch operator plate 24 is provided with a switch contact arm 27 projecting from its rear face into the housing 9 with its terminal end 28 overlying the leaf spring 23. The operator plate 24 is in the initial unactuated position as shown in FIGS. 3A-3C where it may be allowed to drop by gravity and may be limited by any suitable stop means on the housing 9 (not shown). Movement of the plate 24 to this position may be assisted by the bias of the leaf spring 23 or, without the spring 23, by the switch plunger 22 in alternate designs. It would also be possible to return the plate 24 to the horizontal position after actuation by other spring bias means well within the skill of an artisan. With this arrangement, the switch operator plate, when released, may be raised to the switch actuation position by the user's toe as will presently be described in detail.

The safety feature of the foot switch of the present disclosure is provided by a safety mechanism which includes a switch operator blocking arm 29. The arm 29 is typically mounted on the switch operator plate 24 on a pivotal axis 31 which extends at right angles to the pivotal axis 26 of the operator plate. When the switching assembly is in the initial "off" position as shown in FIGS. 1-3C the blocker arm assumes a vertical orientation at right angles to the switch operator plate 24. The arm 29 is provided with an extension 32 as shown in FIG. 3A. The blocking arm is held in the vertical unactuated position by means of the tension spring 33 connected between the extension 32 and the switch operator plate. Suitable stop means (not shown) may be provided on the operator plate to limit the arm 29 to the vertical position. The terminal end of the extension 32 is designed to contact a bearing surface 34 which, in the present disclosed embodiment, comprises a raised surface on the inner bottom wall of the housing 9. The blocking arm 29 when in the vertical position shown in FIGS. 3A-3C thus prevents pivoting or lifting of the switch operator plate 24 in the clockwise direction viewed in FIGS. 38 and 3C. In order for the switch contact arm 27 to depress the leaf spring 23 and switch plunger 22, the blocking arm 29 must first be rotated counterclockwise about its pivot 31 to a substantially horizontal position by the user's foot. The operator plate 24 must then be raised and pivoted about its axis 26 by the user's toe. Without these two distinct horizontal and vertical movement of the user's foot and toe the switch cannot be moved to the closed position. Insertion of the user's foot beneath operator plate 24 is impossible without first rotating the blocker arm 29.

FIGS. 1-3C illustrate the initial unactuated position of the safety switch mechanism. In this position, the operator plate 24 is in its normal substantially horizontal position and the blocking arm 29 is in the vertical position shown such that the user's foot, guided by the curved wall surface 17 if necessary, may be placed with the toe beneath the housing 9 in preparation for moving the blocker arm 29 in a horizontal direction. The switch contact arm 27 on the plate 24 has, at this position, not yet depressed the leaf spring 23.

Figure 5:
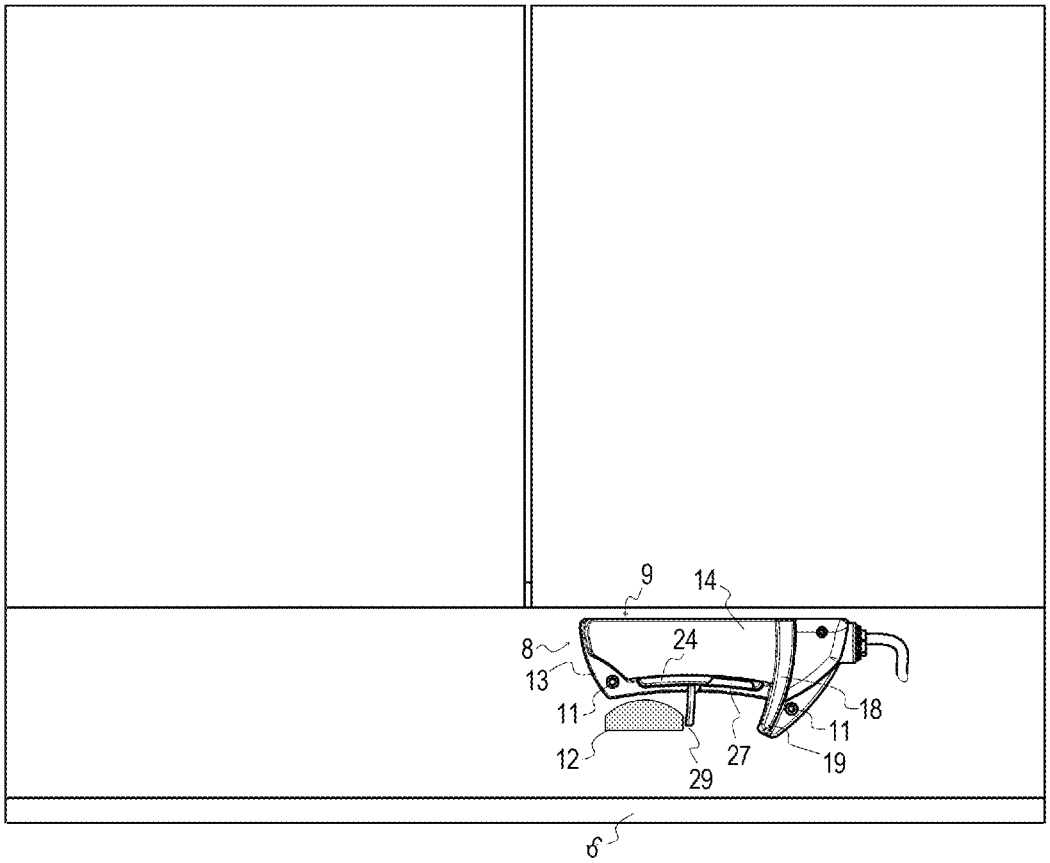
FIG. 5 is a front elevational view of the installed switch, switch operator and safety mechanism of FIG. 4.
Figure 6:
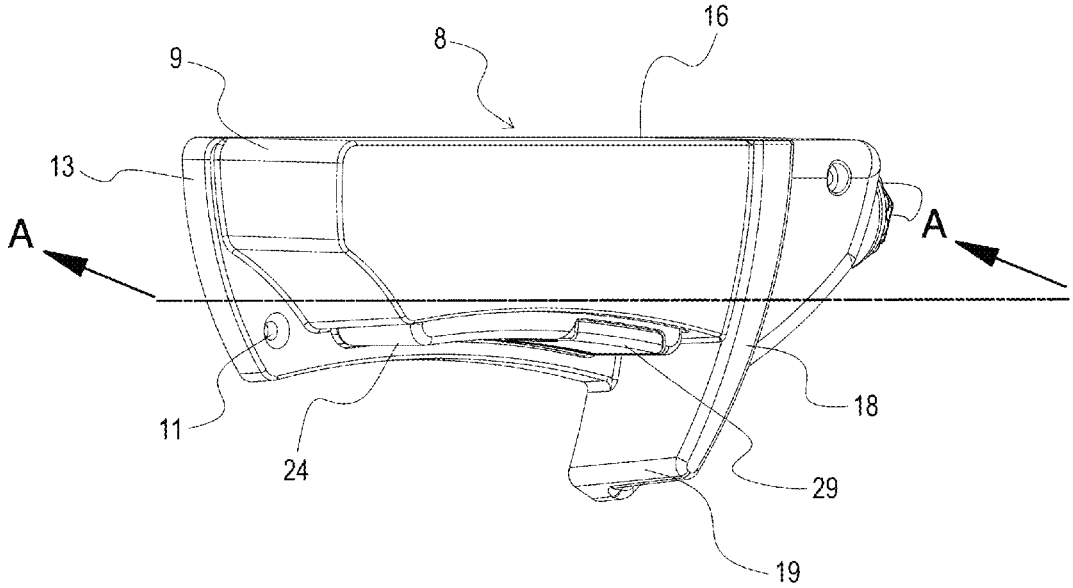
FIG. 6 is a perspective view of the switch, switch operator and safety mechanism of FIG. 5.
Figure 6A:
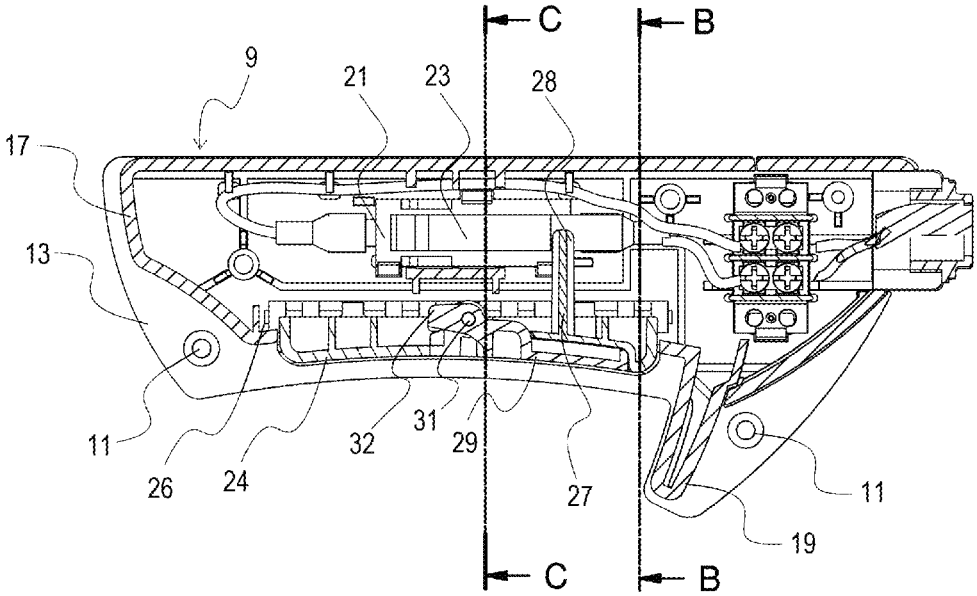
FIG. 6A is a cross sectional view taken along lines A-A of FIG. 6.
Figure 6C:
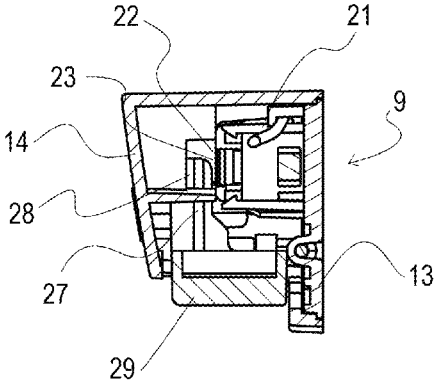
FIG. 6C is a cross sectional view taken along lines C-C of FIG. 6A.
Figure 6B:
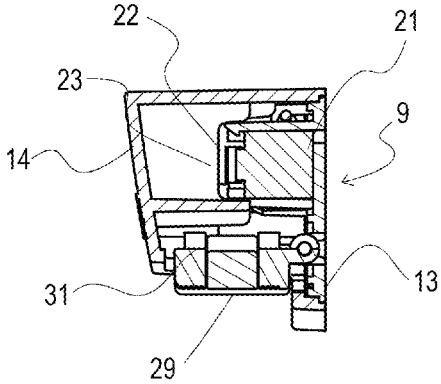
FIG. 6B is a cross sectional view taken along lines B-B of FIG. 6A.

The second position of operation is illustrated in FIGS. 5-6C wherein the user's foot has been moved sideways or horizontally so as to rotate the blocking arm 29 about its pivot 31 to a position against the surface of the operator plate 24 against the bias of spring 33. The switch contact arm 27 in this position is not yet depressing the leaf spring 23 and switch plunger 22. At this point, the user's toe will be slightly elevated above the floor 6 and restrained from further sideways movement by the vertical stop 19 of the switch housing.

The third or actuated position of the switching assembly is shown in FIGS. 7-9C. Once the blocker arm 29 has been pivoted upwardly with the extended end 32 being moved away from the surface of the raised portion 34, the operator plate 24 may be rotated upwardly about its axis 26 to bring the contact arm 27 inwardly with its terminal end 28 now depressing the leaf spring 23 and switch plunger 22, moving the switch to the "on" position. When the user's toe is removed, the operator plate 24 is allowed to return, in this embodiment assisted by the leaf spring 23, to its original horizontal position and the blocking arm 29 is moved or rotated by action of the tension spring 33 to its initial vertical position with extended end 32 in contact with surface 34, blocking any further rotation of the switch operator arm 24 as shown in FIGS. 1-3C.

Although the present embodiments have been described in considerable detail with reference to certain structural details and configurations, other embodiments are possible. For instance, variations may be made in the structural details of the housing assembly so as to accommodate various switch designs, modifications may be made in the actual switch contact members and various modifications are also possible in the configuration of various stop surfaces and spring bias means without departing from scope and content of the inventive concepts disclosed.

I claim:

1. A switch and switch operator assembly mountable beneath an upper surface of a recessed area, comprising:

a housing, the housing having rear and top walls joined to a front wall, the front wall having a lower edge positioned below the level of the top wall;

an end wall joined to the rear, top and front walls, the end wall having a lower edge that depends below the level of the lower edge of the front wall;

a switch operator plate pivotably connected to the housing along a horizontal axis parallel to the plane of the rear wall;

a switch operable in response to the upward, pivotal movement of the switch operator plate;

a blocking arm pivotably mounted to the switch operator plate along a horizontal axis perpendicular to the rear wall of the housing, the blocking arm being mounted to block upward pivoting of the switch operator plate when the blocking arm is in a vertical position and to unblock such pivotal movement of the switch operator plate when the blocking arm is in a horizontal position; whereby a first, lateral movement against the blocking arm and a subsequent vertical movement against the switch actuator plate is necessary to activate the switch.

2. The switch and switch operator assembly of claim 1 further comprising:

a first biasing member for biasing the blocking arm into a vertical position.

3. The switch and switch operator assembly of claim 1 further comprising:

a second biasing member for biasing the switch operator plate away from a position in which the switch may be actuated.

4. A switch operator assembly mountable beneath an upper surface of a recessed area comprising:

a mount to which a switch is mounted;

a switch operator member mounted to the mount and constrained to vertical motion relative to the mount between a first, switch activating position and a second, switch deactivating position, the switch operator member being biased toward the second, switch deactivating position;

a blocking member mounted relative to the switch operator member, the blocking member being movable laterally, relative to the mount, between a first position in which movement of the switch operator member from the second position to the first position is blocked, and a second position in which such motion is not blocked, the blocking member being biased toward its first position, in which movement of the switch operator member is blocked;

a first biasing member acting between the mount and the switch operator member to bias the switch operator member toward its second, switch deactivating position, the switch being configured to be activated by a user by insertion of a toe portion of a foot beneath the mount, moving the foot laterally beneath the mount to move the blocking member from its first, blocking position to the second, unblocking position and then raising the toe portion to move the switch operator member from its second, deactivating position to its first, switch activating position.

5. The switch operator assembly of claim 4 wherein the blocking member is pivotally mounted to the switch operator member.

6. The switch operator assembly of claim 4 further comprising a stop on the mount positioned adjacent one side of the switch operator member for limiting lateral movement of a foot beneath the mount.

* * * * *